United States Patent [19]

Murasawa et al.

[11] 4,270,485

[45] Jun. 2, 1981

[54] LIQUID DEVELOPING APPARATUS

[75] Inventors: Sadao Murasawa, Itami; Hajime Murakami, Moriyama; Hiroshi Ichida, Shiga, all of Japan

[73] Assignee: Ishihara Sangyo Kaisha Ltd., Osaka, Japan

[21] Appl. No.: 86,038

[22] Filed: Oct. 18, 1979

[30] Foreign Application Priority Data

Oct. 23, 1978 [JP] Japan ..... 53-130276

[51] Int. Cl.[3] ..... G03G 15/10

[52] U.S. Cl. ..... 118/648; 118/660

[58] Field of Search ..... 118/648, 660; 430/103, 430/119; 355/10

[56] References Cited

U.S. PATENT DOCUMENTS

| | | | |
|---|---|---|---|
| 3,784,397 | 1/1974 | Sato et al. | 430/103 |
| 3,831,556 | 8/1974 | Sato et al. | 118/648 X |
| 3,862,619 | 1/1975 | Fukushima et al. | 118/648 |
| 4,165,686 | 8/1979 | Borelli et al. | 118/648 X |

FOREIGN PATENT DOCUMENTS 52-6169 2/1977 Japan .

*Primary Examiner*—Evan K. Lawrence

*Attorney, Agent, or Firm*—Cushman, Darby & Cushman

[57] ABSTRACT

A liquid developing apparatus for developing a latent electrostatic image by contacting a liquid developer with an electrophotographic photoreceptor bearing said latent electrostatic image on the undersurface thereof while moving the electrophotographic photoreceptor horizontally over a liquid developing bath. In the apparatus, a number of horizontally spaced developing electrodes in the form of bars having a vertical cross-section in the shape of a tetragon are disposed in the bath very near the undersurface of the photoreceptor. When the liquid developing apparatus is used, an electrophotographic image can be obtained having a high quality but being free from non-uniformity of image density, edge effect and flow of image or streaks.

4 Claims, 6 Drawing Figures

LIQUID DEVELOPING APPARATUS

BACKGROUND OF THE INVENTION

This invention relates to a liquid developing apparatus for electrophotography, in which a number of horizontally spaced developing electrodes are disposed very near the undersurface of a photoreceptor, which surface bears a latent electrostatic image, and said electrodes have an improved vertical cross-sectional shape to facilitate the movement of toner particles to the latent electrostatic image on the undersurface of the photoreceptor, whereby an electrophotographic image can be obtained having a high quality and free from non-uniformity of image density, edge effect and flow of image or streaks.

In electrophotography, the surface of a photoreceptor is charged, and then exposed to image light to form a latent electrostatic image thereon, after which the latent image is developed with toner particles. As the developing system, there are known cascade development, fur brush development, liquid development and the like, among which liquid development is suitable when aiming at preparing a high quality image having a high resolving power.

On the other hand, in such an electrophotographic development, in general, edge effect, streaks, halo effect and the like tend to occur, and in order to prevent these, for example, a method of disposing the developing electrodes in parallel to and near the photoreceptor is usually used. The effect of the developing electrodes is increased as the distance between the photoreceptor and the developing electrodes is narrowed. However, when the distance is too narrow it becomes difficult to supply a sufficient amount of a developer in which toner particles are suspended at the desired concentration in the gap between the photoreceptor and the developing electrodes, whereby the amount of the toner particles contacted with the photoreceptor is decreased and hence an image having the desired density cannot be obtained. Moreover, an image density gradient is formed in the direction of the relative flow of the liquid developer, and hence, the reproduction of a precise image becomes impossible. In order to solve this problem, for example, a proposal has been made for making a plurality of pores or slits in the developing electrodes to facilitate the supply of a sufficient amount of a liquid developer in which toner particles are suspended at the desired concentration through the pores or slits. However, such a proposal is not necessarily satisfactory, and in particular, when the moving speed of the photoreceptor is increased, no uniform image density is obtained and a flow of the image or streaks are caused.

Furthermore, when the photoreceptor is moved at a speed relative to the liquid developer, it has been found that a boundary layer is formed which starts at the forward end of the photoreceptor in relation to the direction of movement and the thickness of which layer increases as the layer approaches the backward end, and therefore, even if pores or slits are made in the developing electrodes the liquid developer cannot sufficiently pass through the gaps between the photoreceptor and the developing electrodes owing to resistance caused by viscous friction, and hence, an advantage of making the pores or slits in the developing electrodes is difficult to obtain. In addition, when the liquid developer is forcibly passed through the gap between the photoreceptor and the developing electrodes from the pores or slits by means of pressure, it has also been found that the relative speed between the photoreceptor and the liquid developer becomes locally abnormal and streaks are formed.

SUMMARY OF THE INVENTION

It is an object of this invention to provide an improved liquid developing apparatus by which a high quality image having fewer defects is obtained even in the so-called high speed development in which a photoreceptor is contacted with a liquid developer while moving the photoreceptor at a high speed.

It is another object of this invention to provide an improved developing electrode for the abovementioned liquid developing apparatus.

Other objects and advantages of this invention will become apparent from the following description.

According to this invention, there is provided a liquid developing apparatus for electrophotography comprising means for horizontally moving an electrophotographic photoreceptor bearing a latent electrostatic image on its surface at a rate of 1 to 15 cm/sec while holding the photoreceptor with the image-bearing surface facing down underneath said means; a developing bath for a liquid developer for contacting the undersurface of the photoreceptor with a liquid developer contained in the bath when the photoreceptor passes over the bath, said developing bath being positioned under the above moving means; and a number of horizontally spaced developing electrodes in the form of bars disposed in the bath so that when the photoreceptor passes over the developing bath the upper surface of the electrodes are very near the undersurface of the photoreceptor, characterized in that the developing electrodes are placed horizontally and parallel to one another at an angle of 45° to 90° to the direction of movement of the photoreceptor; the upper surface of each electrode is substantially flat; the leading edge of the upper surface of each of the electrodes in relation to the direction of movement of the photoreceptor faces the undersurface of the photoreceptor at a constant distance of 0.2 to 1 mm; each of the bar-like developing electrodes has a vertical cross-section, the shape of which is a tetragon or its modified shape which can be inscribed in a rectangle of a width of 0.2 to 10 mm and a height of 1 to 20 mm, the upper side of the rectangle being parallel to the undersurface of the photoreceptor; and the distance between any two adjacent electrodes is 0.4 to 5 mm.

BRIEF DESCRIPTION OF THE DRAWINGS

This invention is illustrated below referring to the accompanying drawings, in which.

DESCRIPTION OF THE PREFERRED EMBODIMENTS

Figure 1:
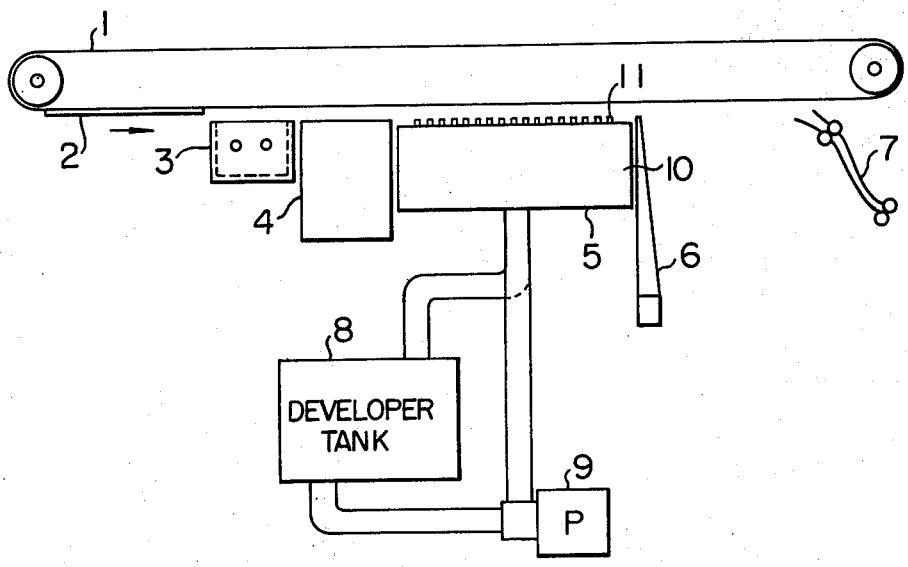
FIG. 1 is a schematic front view of an example of the liquid developing apparatus of this invention for showing the arrangement of a plurality of means.
Figure 2:
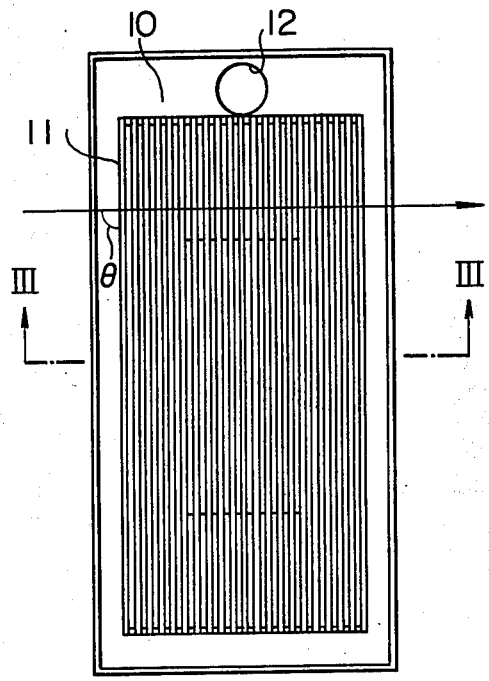
FIG. 2 is an enlarged top plan view of a developing bath in which developing electrodes are disposed.
Figure 3:
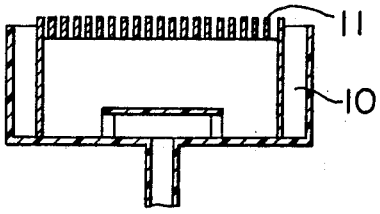
FIG. 3 is a cross-sectional view of the developing bath of FIG. 2 taken along the III—III line.

The whole of the liquid developing apparatus of this invention is shown in FIGS. 1, 2 and 3. A photoreceptor 2 is moved in the direction of the arrow at a rate of 1 to 15 cm/sec by means of a conductive endless belt 1, charged on a corona charger 3 and then exposed to light on a projection system 4 to allow the photoreceptor to carry a latent electrostatic image on its undersurface, after which the photoreceptor passes over a developing bath 5. The liquid developer stored in a liquid developer tank 8 is fed to the developing bath 5 by the action of a pump 9 and flows gently upwards in the bath to overflow from the spaces between developing electrodes 11 and is then recovered from a recovering part for used developer 10 through an outlet 12 to the liquid developer tank 8. The latent electostatic image on the photoreceptor 2 is contacted with the liquid developer over the developing electrodes to be developed, and thereafter, the photoreceptor having the developed image is dried by air knife 6 and taken out of the system by means of a recovery mechanism for developed receptor 7.

The unit means used in the above apparatus, and the combination and arrangement of the means may be modified without departing from the spirit and scope of this invention by use of a knowledge of a conventional liquid developing apparatus for electrophotograph and are not limited to those shown in the drawings.

When the photoreceptor is moved in a certain direction in contact with the liquid developer, a boundary layer of laminar flow is formed which contacts with the undersurface of the photoreceptor, and the thickness of which is increased gradually from the forward end of the photoreceptor to the backward end. Accordingly, the relative flow rate of the liquid developer to the photoreceptor at the portion at which the photoreceptor contacts the liquid developer becomes substantially zero. The contact of toner particles with the latent electrostatic image on the surface of the photoreceptor is effected through the boundary layer by means of an electrostatic attraction, and therefore, the developing speed is lower near the backward end of the boundary layer, in which the layer is thick, than near the forward end of the layer, in which the layer is thin, and an image density gradient is formed on the developed receptor.

Figure 4:
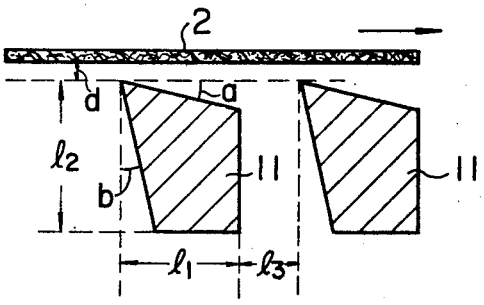
FIG. 4 is a cross-sectional view showing the relationship between the photoreceptor and the developing electrodes and also showing the shape of cross-section of the developing electrodes.

In order to prevent this phenomenon, in this invention, the developing electrodes are disposed very near the undersurface of the photoreceptor, whereby the development is effected while inhibiting the growth of the boundary layer of laminar flow. The distance between the undersurface of the photoreceptor and the developing electrodes must be less than the thickness of the boundary layer which is supposed to be formed. The thickness of the boundary layer is determined depending upon the viscosity and specific gravity of the liquid developer; the moving speed of the photoreceptor; and the distance from the forward end of the photoreceptor. However, if the most conventional conditions are assumed to be that the solvent used in the liquid developer is Isoper H (a trade name of Esso Kagaku K.K. for an isoparaffinic compound), the moving speed of the photoreceptor is 15 cm/sec and the length of the photoreceptor in the direction of its movement is 38 cm, the thickness of the boundary layer at the most backward end could be inferred to be about 1.0 mm. Accordingly, the distance between the undersurface of the photoreceptor and the top of the developing electrodes indicated as d in FIG. 4 is required to be up to 1.0 mm, and it is preferably 0.2 to 0.5 mm.

When the developing electrodes are disposed very near the undersurface of the photoreceptor as mentioned above, it is difficult in some cases for the liquid developer to flow through the gaps between the photoreceptor and the developing electrodes and the smooth supply of toner particles to the gaps becomes difficult. However, such difficulties can be solved by using the present electrodes in the form of bars having the specific shape disposed in the specific positions.

The many bar-like electrodes used as the developing electrodes in the apparatus of this invention are disposed substantially throughout the whole of the developing bath as shown in FIGS. 2 and 3, and placed in parallel to one another and at an angle of 45° to 90°, preferably 90°, between the direction of movement of the photoreceptor and the axial lines of the electrodes, said angle being indicated as $\theta$ in FIG. 2. When the angle is less than 45°, the effect of a convection brought about by the specific shape of vertical cross-section of the electrodes is diminished as described hereinafter, and therefore, such small angles are not desirable.

Figure 5A:
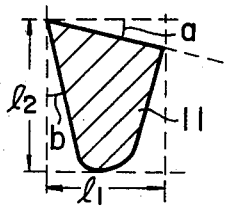
FIG. 5A is a cross-sectional view of another example of the shape of cross-section of the developing electrode.
Figure 5B:
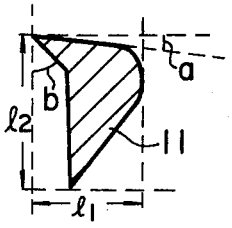
FIG. 5B is a cross-sectional view of a further example of the shape of cross-section of the developing electrode.

Each of the above-mentioned electrodes is in the form of a bar, the vertical cross-section of which has a shape of a tetragon or its modified shape inscribed in a rectangle of 0.2 to 10 mm in width and 1 to 20 mm in height, the upper side of the rectangle being parallel to the undersurface of the photoreceptor. Typical examples of the shape of cross-section are shown in FIGS. 4, 5A and 5B. FIG. 4 indicates an example of a tetragonal cross-section and FIGS. 5A and 5B indicate examples of modification by which corners of the tetragon are rounded or the sides of the tetragon are curved. The width and height mentioned above correspond to $l_1$ and $l_2$, respectively, in FIGS. 4, 5A and 5B, where they can be regarded as the width and height of the electrode per se, respectively.

Usually, the upper surface of the electrode is substantially flat and parallel to the undersurface of the photoreceptor because it affects directly the function of electrode. However, the upper surface of each of the electrode is preferably sloped down from the leading side to the trailing side at an angle of 0° to 30° from a plane parallel to the direction of movement of the photoreceptor, which angle is indicated as a in FIGS. 4, 5A and 5B. Since the development of the latent electrostatic image on the surface of the photoreceptor is effected by contacting the image with the liquid developer containing toner particles comprising a pigment, a resin and the like through the boundary layer having a thickness limited to d, the angle a is made larger than 0° to facilitate the contact of a fresh liquid developer with the surface of the photoreceptor, thereby increasing the developing speed. However, when the angle a is too large and hence $d+l_1 \tan a$ becomes too great, it follows that a part of the upper surface of the electrode does not act effectively as an electrode and the effective space for development becomes too small. Therefore, in view of the relation to $l_1$ and d, a suitable value should be set. In the case of a high speed development in which the speed of the photoreceptor is great during the development, for example, 10 cm/sec, it is particularly advantageous that the angle a is 3° to 30°, preferably 5° to 10°.

The angle between the vertical plane and the back side of the electrode in relation to the direction of movement of the photoreceptor, which angle is indicated as b in FIGS. 4, 5A and 5B, is provided for the purpose of enabling the flow of the liquid developer caused accompanying the movement of the photoreceptor to form a natural convection in the space between any two adjacent electrodes, thereby always supplying smoothly a fresh liquid developer containing toner particles at the desired concentration to the boundary layer. This angle b is determined depending upon the moving speed of the photoreceptor, and the viscosity and specific gravity of the liquid developer. However, when Isoper H is used as the solvent for the liquid developer and the moving speed of the photoreceptor is 1 to 15 cm/sec, the said angle is suitably in the range of $0° \leqq b \leqq 60°$. The supply of toner particles to the latent image surface is mainly effected by the motion of the photoreceptor and the convection caused in the space between any two adjacent electrodes owing to the specific shape of the electrode, and therefore, in the developing bath, it is sufficient to give the whole of the liquid developer a gentle upward flow to such an extent as to help the occurrence of the convection. When the angle b is not suitable, an undesired flow is caused in the space between any two adjacent electrodes, whereby the supply of a fresh liquid developer to the latent image surface is prevented. Therefore, the developing efficiency is lowered, and such phenomena as reduction of image density, occurrence of density gradient and the like are caused.

The other sides of the electrode than those forming the angles a and b have no limitation in relation to direction and shape, and as shown in FIGS. 5A and 5B, they are not always of linear planes.

The width of each electrode indicated as $l_1$ in FIGS. 4, 5A and 5B is preferably a suitable value within the range of 0.2 to 10 mm in view of the relation to the distance between two adjacent electrodes which is discussed hereinafter. The height indicated as $l_2$ in FIGS. 4, 5A and 5B is preferably 1 to 20 mm, more preferably 2 to 10 mm from the viewpoint of preventing the liquid developer from staying in the space formed between any two adjacent electrodes.

In the liquid developing apparatus of this invention, a number of the above-mentioned electrodes in the form of bars are arranged at constant intervals. The distance between two adjacent electrodes indicated as $l_3$ in FIG. 4 is preferably as narrow as possible because it is regarded as substantially non-developable space. However, in order not to cause resistance to the liquid flow for supplying a fresh liquid developer on the surface of the boundary layer formed by the movement of the photoreceptor, said distance is required to be a suitable value within the range of 0.4 to 5 mm, preferably 1 to 3 mm. Moreover, it is necessary to consider the relationship between the width of each electrode and the distance between the adjacent electrodes, and therefore, it is preferred that the ratio of $l_3/l_1$ is about 0.5 to 2.

The advantages of the liquid developing apparatus of this invention are as follows:

(1) Since the development is conducted while moving the photoreceptor, a boundary layer of a liquid developer is formed on the surface of the photoreceptor, and the growth of the layer prevents a fresh liquid developer from being supplied to the developing surface. However, in the liquid developing apparatus of this invention, a number of horizontally spaced developing electrodes are disposed very near the undersurface of the photoreceptor to inhibit the growth of the boundary layer, and the contact of the undersurface of the photoreceptor with a fresh liquid developer is facilitated.

(2) Disposing the developing electrodes very near the undersurface of the photoreceptor as mentioned above results in the above-mentioned advantages, but it becomes, on the other hand, difficult in some cases for the liquid developer to pass through the narrow space between the undersurface of the photoreceptor and the upper surfaces of the electrodes, and therefore, there is induced a disadvantage that the contact of the undersurface of the photoreceptor with a fresh liquid developer becomes bad. However, in the liquid developing apparatus of this invention, this disadvantage has been overcome by placing a number of bar-like developing electrodes having a shape of vertical cross-section different from that of a conventional electrode in the specific position.

Accordingly, the use of the liquid developing apparatus of this invention enables the production of a high quality homogeneous image having a high resolving power and free from non-uniformity of image density, edge effects, streaks and the like. In particular, even in a high speed development, a sharp image free from a gradient of image density can be obtained, and this is a very great advantage.

What is claimed is:

1. A liquid developing apparatus for electrophotography comprising means for horizontally moving an electrophotographic photoreceptor bearing a latent electrostatic image on its surface at a rate of 1 to 15 cm/sec while holding the photoreceptor with the latent image-bearing surface facing down underneath said means; a developing bath for a liquid developer for contacting the undersurface of the photoreceptor with a liquid developer contained in the bath when the photoreceptor passes over the bath, said developing bath being positioned under the above moving means; and a number of horizontally spaced developing electrodes in the form of bars disposed in the bath so that when the photoreceptor passes over the developing bath the upper surfaces of the electrodes are very near the undersurface of the photoreceptor, characterized in that the developing electrodes are placed horizontally and parallel to one another at an angle of 45° to 90° to the direction of movement of the photoreceptor; the upper surface of each electrode is substantially flat; the leading edge of said upper surface of each of the electrodes in relation to the direction of movement of the photoreceptor faces the undersurface of the photoreceptor at a constant distance of 0.2 to 1 mm; each of the bar-like developing electrodes has a vertical cross-section, the shape of which is a tetragon or its modified shape which can be inscribed in a rectangle having a width of 0.2 to 10 mm and a height of 1 to 20 mm, the upper side of the rectangle being parallel to the undersurface of the photoreceptor; and the distance between any two adjacent electrodes is 0.4 to 5 mm.

2. An apparatus according to claim 1, wherein the upper surface of each of the developing electrodes is sloped down from said leading edge to the trailing edge of the upper surface at an angle of 3° to 30° from a plane parallel to the direction of movement of the photoreceptor.

3. An apparatus according to claim 1, wherein the height of said rectangle is 2 to 10 mm.

4. An apparatus according to claim 1, wherein the distance between any two adjacent electrodes is 1 to 3 mm.

* * * * *